United States Patent [19]

Templeton et al.

[11] Patent Number: 4,755,159

[45] Date of Patent: Jul. 5, 1988

[54] CARRYING CASE USABLE AS A TOY BUILDING OR TOY PLAYGROUND

[75] Inventors: Sheldon Templeton, Rancho Palos Verdes; Paul Norris, Redondo Beach; Roger Newbold, Garden Grove, all of Calif.; Mary K. Litwicki, Scottsdale, Ariz.

[73] Assignee: Mattel, Inc., Hawthorne, Calif.

[21] Appl. No.: 885,899

[22] Filed: Jul. 15, 1986

[51] Int. Cl.[4] ..... A63H 3/52; A63H 33/06

[52] U.S. Cl. ..... 446/76; 446/110; 446/476; 446/478

[58] Field of Search ..... 446/75, 76, 110, 115, 446/168, 476, 478, 487; 220/340, 341

[56] References Cited

U.S. PATENT DOCUMENTS

| | | | |
|---|---|---|---|
| Re. 26,642 | 8/1969 | Bender | 446/478 |
| 1,258,788 | 3/1918 | Koch | 446/110 |
| 1,955,194 | 4/1934 | Leake | 446/110 |
| 2,040,974 | 5/1936 | Bigelow | 446/477 |
| 2,734,307 | 2/1956 | Oravets | 446/418 |
| 2,872,753 | 2/1959 | Fenton | 446/478 |
| 3,363,360 | 1/1968 | Ryan | 446/478 |
| 3,400,485 | 9/1968 | Callin et al. | 446/76 |
| 3,731,420 | 5/1973 | Crosman | 446/73 |
| 3,769,743 | 11/1973 | Benkoe et al. | 446/3 |
| 3,849,930 | 11/1974 | Stubbmann | 446/71 |
| 3,923,180 | 12/1975 | Fields | 220/337 |
| 4,030,234 | 6/1977 | Allen et al. | 446/478 |
| 4,055,019 | 10/1977 | Harvey | 446/115 |
| 4,109,985 | 8/1978 | Lieb, Jr. | 446/487 |
| 4,131,227 | 12/1978 | Patton et al. | 446/76 |
| 4,139,967 | 2/1979 | Kuna et al. | 446/476 |
| 4,161,081 | 7/1979 | Katzman et al. | 446/314 |
| 4,195,437 | 4/1980 | Ace | 446/110 |
| 4,285,157 | 8/1981 | Lambert | 446/76 |
| 4,349,983 | 9/1982 | Kilroy et al. | 446/75 |
| 4,508,519 | 4/1985 | Becker | 446/478 |
| 4,670,809 | 6/1987 | Teuber | 220/337 |

FOREIGN PATENT DOCUMENTS

| | | | |
|---|---|---|---|
| 334453 | 3/1921 | Fed. Rep. of Germany | 446/75 |
| 354706 | 7/1961 | Switzerland | 446/478 |
| 289615 | 5/1928 | United Kingdom | 446/110 |
| 22142 | 7/1984 | United Kingdom | 446/110 |

*Primary Examiner*—Robert A. Hafer
*Assistant Examiner*—Charles H. Harris
*Attorney, Agent, or Firm*—Ronald M. Goldman; Melvin A. Klein; Daniel F. Sullivan

[57] ABSTRACT

A carrying case which may be used as a toy building or toy playground. The carrying case has two foldable sides rotatably and removably hinged to its base by breakaway hinges featuring ball and socket portions. The other two sides of the carrying case remain in a vertical position attached to the base. A roof portion is connected to one of the foldable sides by breakaway hinges. The foldable sides and roof portion may be rotated to unfold the carrying case so that it may be used as toy playground. The roof portion has a built-in slide and swing. It may be removed from the carrying case and used as a separate toy. The carrying case may be folded to simulate a toy building or schoolhouse with a roof portion latched to the top of the case.

3 Claims, 4 Drawing Sheets

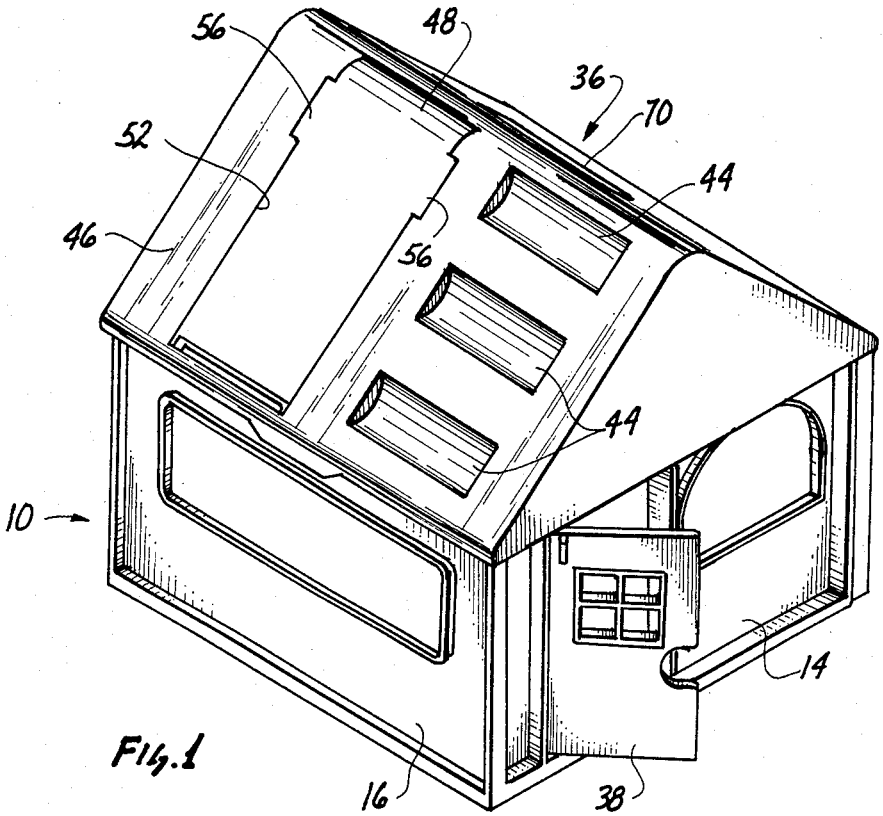
Fig. 1
Fig. 6
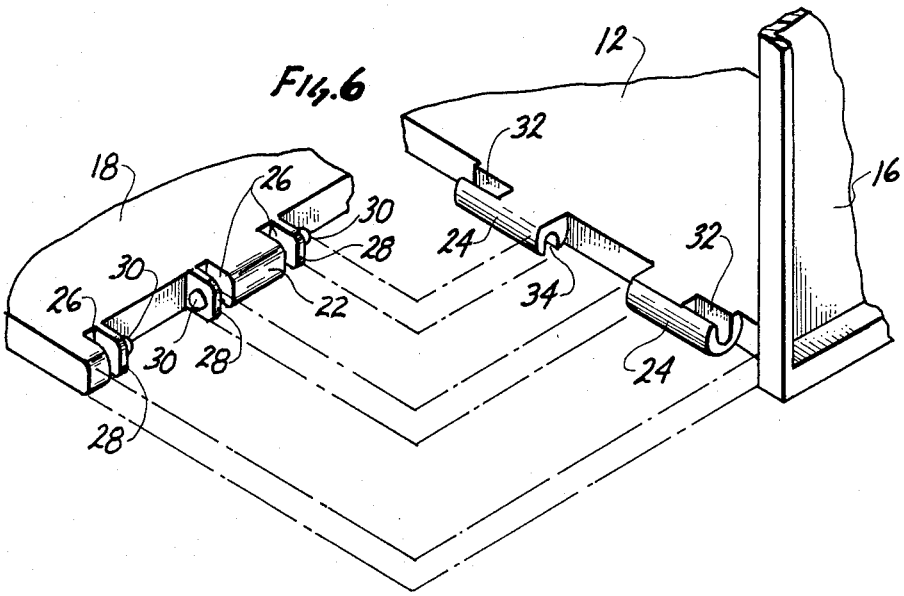

CARRYING CASE USABLE AS A TOY BUILDING OR TOY PLAYGROUND

BACKGROUND OF THE INVENTION

The present invention relates generally to carrying cases and, more particularly, to a carrying case having its sides or walls and a top or roof portion removably hinged to the case in order to allow the case to be used as a toy building or to be unfolded and used as a toy playground.

In the past, a variety of toy buildings and amusement sets have been designed which may be used as carrying cases. For example, carrying cases are disclosed in U.S. Pat. Nos. 4,508,519 issued to Becker on Apr. 2, 1985; 4,349,983 issued to Kilroy et al on Sept. 21, 1982; 4,285,157 issued to Lambert on Aug. 25, 1981; 4,161,081 issued to Katzman et al on July 17, 1979; 4,139,967 issued to Kuna et al on Feb. 20, 1979; 4,131,227 issued to Patton et al on Dec. 26, 1978; 4,030,234 issued to Allen et al on June 21, 1977; 3,769,743 issued to Benkoe et al on Nov. 6, 1973; 3,731,420 issued to Crosman on May 8, 1973; Re. 26,642 reissued to Bender on Aug. 12, 1969; 3,400,485 issued to Callin et al on Sept. 10, 1968 and 2,040,974 issued to Bigelow on May 19, 1936. Toy buildings are described in U.S. Pat. Nos. 3,849,930 issued to Stubbmann on Nov. 26, 1974 and 2,734,307 issued to Oravets on Feb. 14, 1956. Finally, German Pat. No. 334453 dated Mar. 14, 1921 discloses a toy building.

None of the above patents discloses a carrying case having its sides or walls removably hinged to the base of the case and a top or roof portion removably hinged to one of the walls in order to allow the case to be used as a toy building or unfolded and used as a toy playground. Since the walls and roof portion are removably hinged to the case, these parts may be removed and used separately, providing additional play options for a child. Built-in features such as a toy swing, slide or door would add to the enjoyment of a child playing with the case. Accordingly, there is a need in the toy manufacturing arts for a carrying case having its sides or walls and a top or roof portion romovably hinged to the case in such a way that the case may be used as a toy building or unfolded and used as a toy playground.

SUMMARY OF THE INVENTION

It is an object of this invention to provide a carrying case which may be used as a toy building or unfolded and used as a toy playground.

It is another object of this invention to provide a carrying case having its sides or walls removably hinged to the base of the case and a top or roof portion removably hinged to one of the walls.

It is still another object of this invention to provide a carrying case having built-in features such as a toy swing, slide or door.

These and other objects and advantages are attained by a carrying case which may be used as a toy building or toy playground. The carrying case has two foldable sides rotatably and removably hinged to its base by breakaway hinges. The other two sides of the carrying case remain in a vertical position attached to the base. A roof portion is connected to one of the foldable sides by breakaway hinges. The foldable sides and roof portion may be rotated to unfold the carrying case so that it may be used as a toy playground. The roof portion has a built-in slide and swing. It may be removed from the carrying case and used as a separate toy. The carrying case may be folded to simulate a toy building or schoolhouse with the roof portion latched to the top of the case.

The various features of the present invention will be best understood, together with further objects and advantages by reference to the following description of the preferred embodiment taken in connection with the accompanying drawings.

BRIEF DESCRIPTION OF THE DRAWINGS

FIG. 1 is a perspective view of the preferred embodiment of the carrying case of the present invention;

FIG. 6 is an enlarged detailed view showing how breakaway hinges used for the carrying case of FIG. 1 may be uncoupled.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 4:
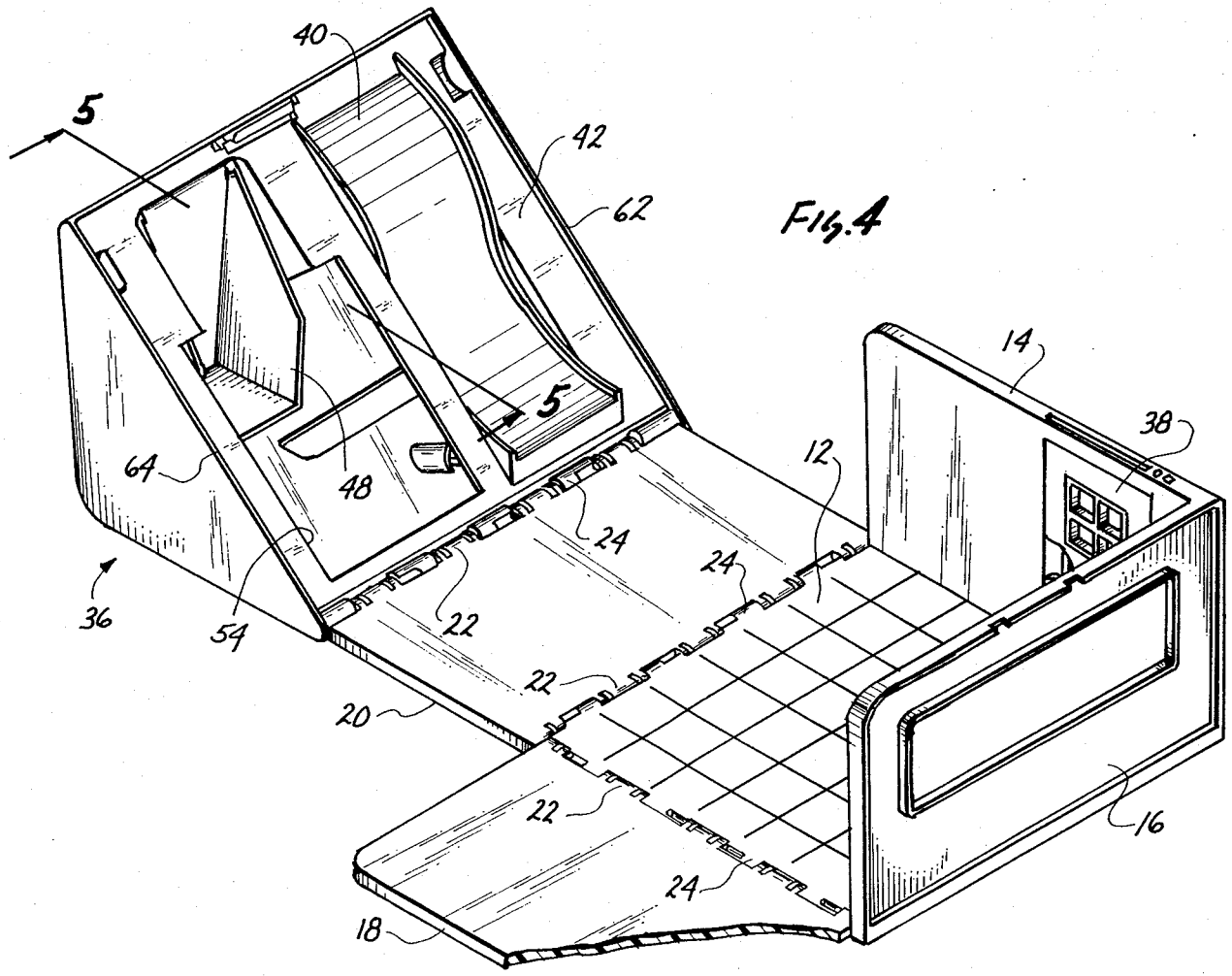
FIG. 4 is a perspective view of the carrying case of FIG. 1 showing the carrying case in an unfolded position simulating a toy playground.

Referring now to the drawings, a preferred embodiment of the carrying case 10 of the present invention is shown in FIG. 1. The carrying case 10 has a base 12 (see FIG. 4) with sides or walls 14, 16, 18 and 20 connected thereto. Walls 14 and 16 are preferably attached to two edges of the base 12 and extend upward from the base as shown in FIG. 4. As shown in FIGS. 4 and 6, walls 18 and 20 are removably and rotatably connected to the other two edges of base 12 by breakaway hinges. The breakaway hinges are formed by projections 22 attached to the walls 18 and 20 which operably engage socket portions 24 attached to the base 12. The projections 22 and socket portions 24 are preferably molded as parts of the walls 18 and 20 and base 12.

As shown in the enlarged detailed view of FIG. 6, each projection 22 has two slots 26 therein forming flexible portions 28. A ball portion 30 is attached to each of the flexible portions 28. In addition, each socket portion 24 has top and bottom channels 32 and 34 therein. The breakaway hinges may be coupled together by pushing the projections 22 and socket portions 22 and 24 together until the ball portions 30 operably engage the channels 32 and 34. The channels 32 and 34 are orientated (alternate) as shown in FIG. 6 so that the ball portions 30 of each projection 22 engage either two top channels 32 or two bottom channels 34. Note that the flexible portions 28 bend sufficiently to allow the ball portions 30 to engage the channels 32 and 34.

The ball portions 30 rotatably engage the channels 32 and 34 allowing the projections 22 and socket portions 24 to rotate with respect to each other.

The breakaway hinges may be uncoupled by simply pulling the projections 22 and socket portions 24 apart so that the ball portions 30 disengage from the channels 32 and 34. The flexibility of portions 28 facilitate pulling the projections 22 and socket portions 22 and 24 apart.

Figure 3:
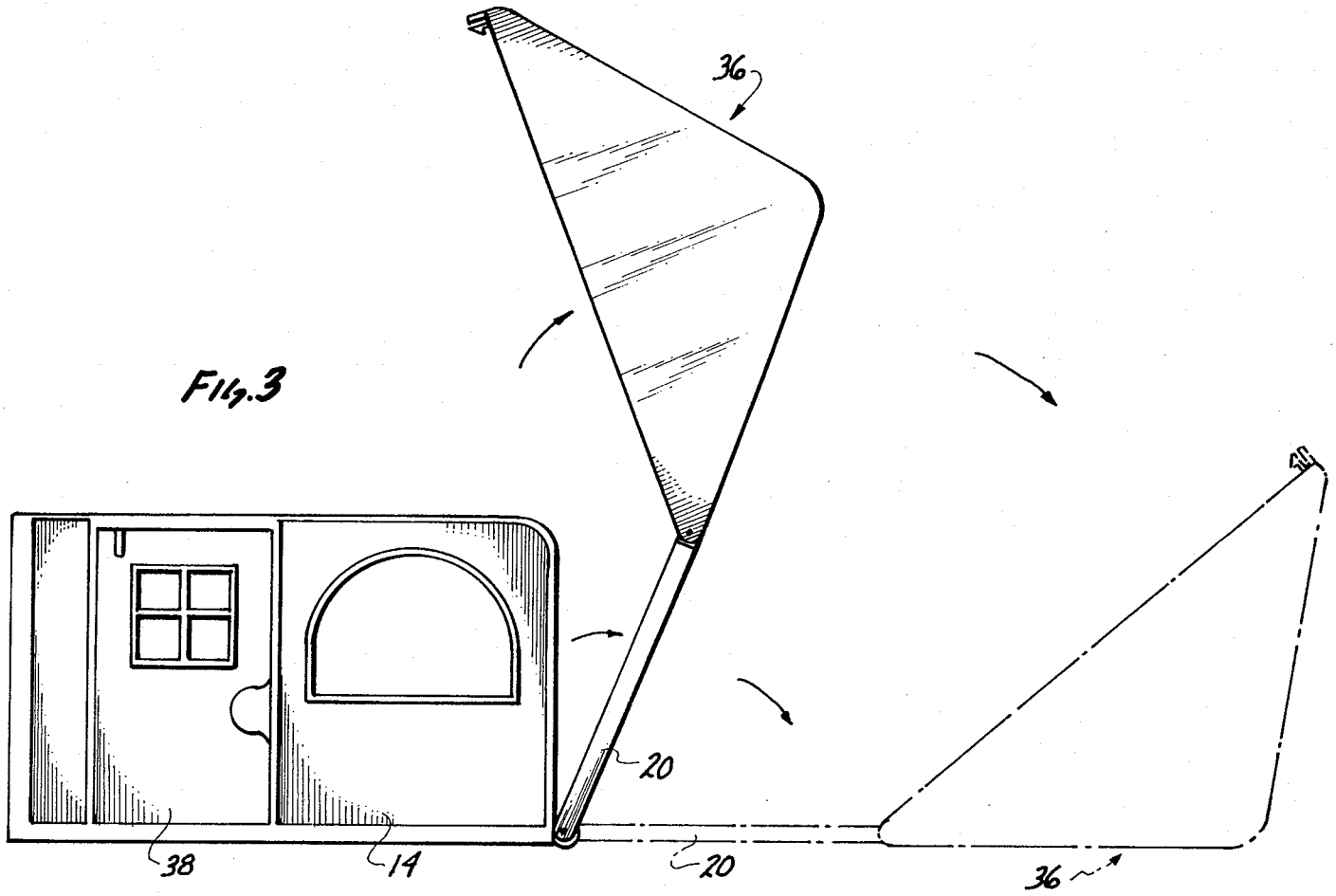
FIG. 3 is a side elevational view of the carrying case of FIG. 1 showing how a top or roof portion and one of the walls may be unfolded.

A top or roof portion 36 is rotatably and removably coupled to the top edge of wall 20 by breakaway hinges using the same type of projections 22 and socket portions 24 previously described. As a result, the carrying case 10 may be unfolded to the position shown in FIG. 4 by rotating wall 20 and roof portion 36 as indicated by the arrows shown in FIG. 3. Note that walls 14 and 16 remain vertical since they are attached to the base 12. When in this unfolded position, the carrying case 10 may be used as a toy playground since a child may place toys and accessories on top of the base 12 and walls 18 and 20.

The carrying case 10 has built-in features which facilitate use as a toy playground. A door 38 is rotatably coupled to wall 14 using any desired coupling means such as hinges, pins and sockets, or the like. A slide 40 is attached to bottom surface 42 of the roof portion 36. Note that concave surfaces 44 are provided at the top surface 46 of the roof portion 36 which a child may pretend are steps for the slide 40.

Figure 5:
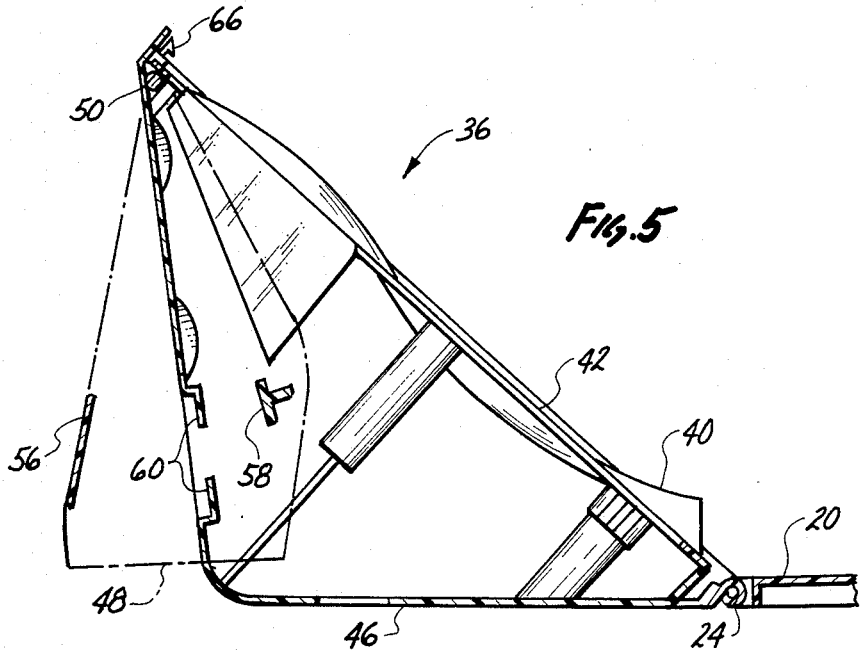
FIG. 5 is cross-sectional view taken in the direction of arrows 5—5 shown in FIG. 4.

In addition, a swing 48 is rotatably coupled to the roof portion 36 by one or more pins 50 (see FIG. 5). Note that any other means of rotatably coupling the swing 48 to the roof portion 36 may be used such as hinges, pins and sockets, or the like. Apertures 52 and 54 in the top and bottom surfaces 46 and 42, respectively, provide access to the swing 48 and allow it to rotate to a vertical position when the roof portion 36 is orientated as shown in FIG. 5. The swing 48 has extensions 56 and 58 attached to it which restrict movement of the swing by coming into contact with flanges 60 when a child rotates the swing back and forth. Also, extensions 56 rest on top of flanges 60 when the carrying case 10 is folded as shown in FIG. 1.

Since the roof portion 36 and walls 18 and 20 are removably connected to the carrying case by breakaway hinges, these parts may be removed from the rest of the case and used separately. For example, a child may use the roof portion 36 with built-in slide 40 and swing 48 by itself or with other toys.

Figure 2:
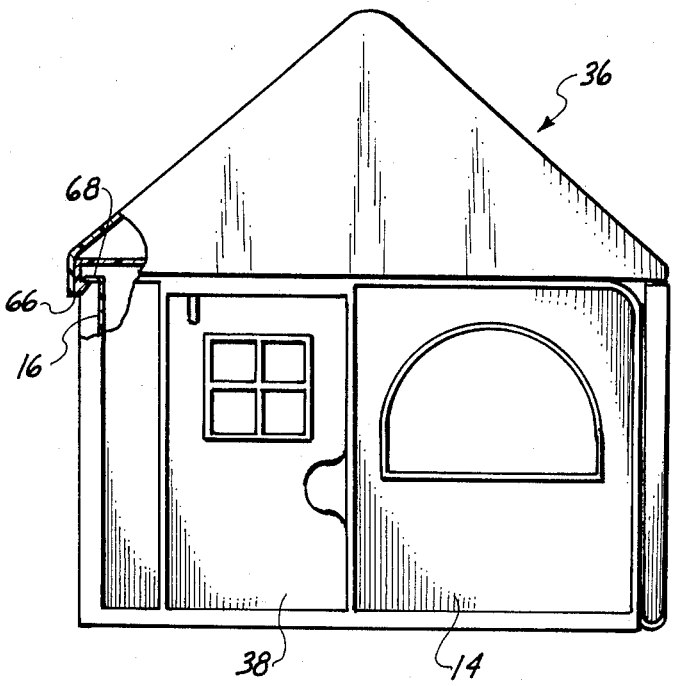
FIG. 2 is a front elevational view of the carrying case of FIG. 1.

The carrying case 10 may be folded (from the position shown in FIG. 4) to resemble a toy building as shown in FIG. 1 or to function as a case for carrying toys and other accessories by first rotating walls 18 and 20 to a vertical position and then moving roof portion 36 (opposite to the arrows shown in FIG. 3) until it snaps shut on top of the case. Walls 18 and 20 are held in place by ridges 62 and 64 (see FIG. 4) attached to the roof portion 36. In addition, latch 66 engages flange 68 at the top of wall 16 as shown in FIG. 2 when the roof portion 36 is snapped shut on top of the carrying case 10. Latch 66 may be easily released (unlatched) in order to unfold the case as shown in FIG. 4. The door 38 may be conveniently opened to place objects inside the carrying case 10 after the roof portion 36 is snapped shut. A child may place his or her fingers into aperture 70 in top surface 46 (see FIG. 1) for the purpose of carrying the case 10.

A child may pretend that the carrying case 10 is a toy building or schoolhouse when folded as shown in FIG. 1. This provides additional play options appealing to the creative imagination of the child.

Even though FIG. 4 shows two walls 18 and 20 rotatably coupled to the base 12, the design of the carrying case 10 may be varied by rotatably coupling one, three or all four walls to the base if desired. The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A carrying case usable as a toy building and a toy playground, comprising:

a base having four sides connected thereto, one of said sides having a first edge thereof rotatably and removably connected to said base;

a roof portion rotatably and removably connected to a second edge of said one side, said second edge being disposed opposite said first edge; and hinge means for rotatably and removably connecting said one side to said base and said roof portion to said one side, said hinge means including:

(a) a plurality of projections, each of said projections having slots therein forming two flexible portions, each flexible portion having a ball portion attached thereto, and (b) a plurality of socket portions, each of said socket portions having a top channel and a bottom channel therein, said top and bottom channels being disposed so that said ball portions of one of said projections are capable of rotatably and removably engaging two of said top channels while said ball portions of another of said projections adjacent said one projection are capable of rotatably and removably engaging two of said bottom channels, wherein said roof portion has a slide attached thereto and a swing rotatably engaged thereto.

2. A carrying case usable as a toy building and a toy playground, comprising:

a base;

two vertical sides attached to said base;

two other sides each having one edge thereof rotatably and removably engaged to said base;

a roof portion rotatably and removably engaged to another edge of one of said two other sides, said another edge being disposed opposite said one edge; and hinge means for rotatably and removably engaging said two other sides to said base and said roof portion to one of said two other sides, said hinge means including:

(a) a plurality of projections, each of said projections having slots therein forming two flexible portions, each flexible portion having a ball portion attached thereto, and (b) a plurality of socket portions, each of said socket portions having a top channel and a bottom channel therein, said top and bottom channels being disposed so that said ball portions of one of said projections are capable of rotatably and removably engaging two of said top channels while said ball portions of another of said projections adjacent said one projection are capable of rotatably and removably engaging two of said bottom channels, wherein said roof portion has a slide attached thereto and a swing rotatably engaged thereto.

3. A carrying case usable as a toy building and a toy playground, comprising:

a base;

two vertical sides attached to said base, one of said two vertical sides having a door rotatably engaged thereto and the other of said two vertical sides having a flange attached to the top end thereof;

a third side having an edge thereof rotatably and removably engaged to said base;

a fourth side having a first edge thereof rotatably and removably engaged to said base;

a roof portion rotatably and removably engaged to a second edge of said fourth side, said second edge being disposed opposite said first edge, said roof portion having a latch attached thereto adapted for removably engaging said flange attached to the other of said two vertical sides, a swing rotatably engaged thereto and a slide attached thereto; and hinge means for rotatably and removably engaging said third and fourth sides to said base and said roof portion to said fourth side, said hinge means including:

(a) a plurality of projections, each of said projections having slots therein forming two flexible portions, each flexible portion having a ball portion attached thereto, and (b) a plurality of socket portions, each of said socket portions having a top channel and a bottom channel therein, said top and bottom channels being disposed so that said ball portions of one of said projections are capable of rotatably and removably engaging two of said top channels while said ball portions of another of said projections adjacent said one projection are capable of rotatably and removably engaging two of said bottom channels.

* * * * *